United States Patent [19]

Holder

[11] Patent Number: 4,655,158

[45] Date of Patent: Apr. 7, 1987

[54] BOAT ANCHOR INCLUDING RELEASABLE COUPLING MEANS

[76] Inventor: Larry Holder, Rt. 1, Bremen, Ga. 30110

[21] Appl. No.: 703,035

[22] Filed: Feb. 19, 1985

[51] Int. Cl.[4] ..... B63B 21/44

[52] U.S. Cl. ..... 114/297; 114/304; 403/DIG. 3

[58] Field of Search ..... 114/294–311; 403/2, 41, 116, 203, DIG. 3

[56] References Cited

U.S. PATENT DOCUMENTS

| | | | |
|---|---|---|---|
| 2,415,605 | 2/1947 | Newby | 114/298 |
| 2,511,286 | 6/1950 | Millen | 114/298 |
| 2,746,414 | 5/1956 | Roberts | 114/298 |
| 2,789,526 | 4/1957 | Gollner | 114/298 |
| 2,990,799 | 7/1961 | Morgan et al. | 114/298 |
| 2,994,292 | 8/1961 | Winslow | 114/298 |
| 4,230,062 | 10/1980 | Fornasiero | 114/297 |

FOREIGN PATENT DOCUMENTS

| | | | |
|---|---|---|---|
| 921 | of 1877 | United Kingdom | 114/310 |

*Primary Examiner*—Sherman D. Basinger
*Assistant Examiner*—Stephen P. Avila
*Attorney, Agent, or Firm*—Herbert M. Hanegan

[57] ABSTRACT

An improved boat anchor assembly including an anchor shank having a fluke pivotally connected thereto and supported for angular displacement about an axis normally related to the longitudinal axis of the shank, motion limiting stops mounted on the shank for arresting pivotal motion of the flukes relative the shank, the shank being provided with a pivotal coupling interposed between the ends thereof and pins for imparting stability to the shank and adapted to deform under angularly applied loads of predetermined magnitudes whereby the shank-fluke connection is permitted to "break" for facilitating recovery of the anchor.

12 Claims, 3 Drawing Figures

BOAT ANCHOR INCLUDING RELEASABLE COUPLING MEANS

BACKGROUND OF THE INVENTION

1. Field of the Invention

The invention generally relates to boat anchors for uses in the so-called small boat industry, and more particularly to an anchor which readily may be recovered in the event the flukes thereof penetrate a mud bottom sufficiently to preclude extraction in a ususal manner.

2. Description of the Prior Art

As can fully be appreciated by those familiar with the small boat industry, anchors designed for use in mud bottoms often are provided with relatively wide, pointed flukes, pivotally supported by a cross head mounted on a shank, whereby the flukes may be penetrate a sand or mud bottom as the anchor is drug thereacross. Often, objects buried in the bottom capture the anchor making extraction in a conventional manner extremely difficult, if not impossible. As a consequence, the loss of an anchor is not uncommon experience. Also, more than one anchor often is carried on-board a vessel, even though stowage space usually is severely limited.

An anchor moors a vessel to the sea bed, generally by a combination of its own weight and by hooking itself into the bottom. An ideal anchor is designed so that a near horizontal pull causes it to dig itself in firmly, but an upward pull dislodges it easily. It is attached to the vessel by a cable—this is a heavy chain on large ships. Anchors in use today provide a more or less firm mooring but require winching in the cable and running the vessel over the anchor's position for its unmooring. When the cable is more or less vertical the anchor should dislodge. However, it does not always dislodge easily. Sometimes, an underwater utility cable, a mangrove root or the like gets caught between the flukes and pulling the anchor out is just an exercise in futility. One of the most popular anchors, the Danforth anchor, is particularly susceptible to this problem.

It has been known for many years that boat anchors can become entangled in underwater obstructions such as rocks, coral reefs, etc. Retrievel of the anchor once it has become entangled is time consuming and there is a substantial probability that the anchor may be lost. It is also known in the prior art that anchors can be designed with a release feature which can be operated at the discretion of the boat operator. If the owner determines that retrieval in the normal manner is not possible, the operator uses the release feature to disengage the flukes from whatever obstruction is encountered. It is also known in the prior art that anchor chains can become entangled in underwater obstructions and it has been suggested that a float on the water surface be provided to keep the chain in a vertical position. A brief summary or pertinent prior art patents illustrating the foregoing will now be provided.

Wixon, in his 1889 U.S. Pat. No. 411,948 entitled "Anchor", describes a device having a pair of sharp, pointed flukes pivoted to an anchor shaft. Each fluke includes a spur portion which is generally parallel to the shaft when the anchor is in its functional position. A ring is slidedly disposed over the shaft and is designed to encircle the spurs to retain the anchor in its normal position. A separate rope is attached to the ring and if the boat owner desires to release the anchor, he pulls the ring upwardly to release the spurs and allow the flukes to drop to a position in which they point downwardly from the shaft.

In Andrews' U.S. Pat. No. 2,674,970 issued Apr. 13, 1954 and entitled "Boat Anchor", the anchor includes three flukes having heart-shaped end points, the flukes being pivotally coupled to the shaft by thin rods. The inner ends of the flukes are recessed into the shaft and a spring-loaded collar slips over the inner ends when the anchor is in its functioning position. By pulling a separate rope, the operator can retract the collar against the spring pressure, allowing the flukes to drop downwardly into a retrieval position.

Bartels, et al. describe a "Collapsible Boat Anchor" in their U.S. Pat. No. 2,940,411 issued June 14, 1960. The anchor includes four thin, ski-shaped flukes pivoted to a bottom plate. Each fluke is also coupled to the shaft by a tie rod. A first end of the tie rod is pivoted to the fluke outwardly from the shaft and the other end of the tie rod is slidably coupled to the shaft through a slot. A ring is coupled to the bottom of the anchor and the anchor rope is attached to this ring. A snatch clip is positioned high on the shaft and the rope passes through the snatch clip before rising to the surface. When underwater obstructions are encountered, the operator jerks the rope to release it from the snatch clip and the anchor is raised from the bottom allowing the flukes to drop downwardly into a retrieval position.

Another prior art device is described in Triechman's U.S. Pat. No. 2,982,244 issued May 2, 1961 for "Collapsible Boat Anchor." This anchor includes four pointed, elongate flukes, each with a notch on the pivoted end. The flukes are held in the functioning position when a locking ring engages the notches. A sliding collar weight is provided to lower the locking ring and allows the flukes to drop into a retrieval position.

Swails, in U.S. Pat. No. 3,021,812 issued Feb. 20, 1962 for "Releasable Anchor" describes a system similar to that of the aforementioned Andrews patent, but this device includes a spring-loaded pin trigger mechanism for releasing the locking collar. The collar is biased toward the release position. Once the pin is released, the flukes drop downwardly for retrieval.

Wheeler, in U.S. Pat No. 3,059,607 issued Oct. 23, 1962 for "Anchor" describes a device which includes elongate, pointed flukes pivotally coupled to a shaft at one end with ties rods slidably coupled to the shaft and movable downwardly thereon to permit the flukes to drop to a retrieval position.

A different arrangement is depicted in Jensen's U.S. Pat. No. 3,123,037 issued Mar. 3, 1964 for "Boat Anchor." In this device, the spring-loading is accomplished below the flukes on an extension of the shaft and the spring urges the flukes to a downward retrieval position. The flukes are pivotally coupled to a first collar. A second collar is secured to the upper end of the shaft and a tie rod is coupled between each fluke and the second collar. A release pin mechanism and second rope are provided for disengaging the pin and placing the anchor in the retrieval position.

Botine's June 23, 1964 U.S. Pat. No. 3,138,134 for a "Boat Anchor" describes another spring-loaded system which includes a plunger and a spring. The bottom of the plunger engages the inner ends of the elongate flukes until sufficient pressure is applied against the spring to cause the anchor to assume its retrieval position.

In U.S. Pat. No. 3,397,665 issued Aug. 20, 1968 for "Boat Anchor", Lindly describes another system employing pivotable flukes and a sliding casing which locks the flukes in the anchoring position. The anchor rope is attached to the casing while a weaker section of the rope is attached to the anchor body. If normal tension is applied to the weaker section, it will hold and the anchor can be raised. If the anchor becomes entangled, greater tension will brake the weak section of the rope allowing the casing to release so the anchor assumes its retrieval position.

Guier, in U.S. Pat. No. 3,450,008 issued June 17, 1969 for "Anchor Having Pivotable Flukes", describes an anchor having a fluke portion formed from pre-cut plates which have holes in them. Rods pass through the holes and are journaled to retain the plates in assembly. A float is also provided which has fins on it. The fins rotate when the anchor is being lowered to act as a drag on anchor descent.

An "Anchor Float Adapter" is described by Sabella in his Jan. 10, 1978 U.S. Pat. No. 4,067,287. The adapter includes a tubular body suspended from a float, the body having quick connect and disconnect features.

All of the aforementioned devices suffer from one or more disadvantages. Many of the devices are unsuitable for use in salt water because of the corrosive effect on parts such as springs, release pins, and the like. Other devices are cumbersome and require time consuming manipulation of two ropes. In addition, most of the devices which employ a quick release feature have sharp, elongate flukes which are not effective when anchoring in sand. An anchor system which overcomes the above-noted disadvantages would be a significant advance in the anchor art.

As a consequence of the aforementioned inadequacies of the prior art anchors, it should now be apparent that there currently exist a need for an improved, lightweight anchor having penetrating flukes which in the event the anchor become "stuck", readily extracted from a bottom with an attendant minimal loss of time and effort.

It is therefore the general purpose of the instant invention to provide an improved penetrating anchor of a design having particular utility in the small boat industry adapted to be readily extracted from the bottom in the event the anchor becomes inextricably lodged.

OBJECTS AND SUMMARY OF THE INVENTION

It is an object of the instant invention to provide an improved penetrating design anchor.

It is another object to provide an improved penetrating anchor having flukes adapted to "break" without separation, for facilitating extraction of the anchor from a bottom.

These and other objects and advantages are achieved through the use of an anchor shank having a cross head pivotally supporting a pair of penetrating flukes, motion limiting stops for limiting the pivotal throw of the flukes relative to the shank, a hub having an arcuate guide slot adapted to release the fluke relative to the shank for accommodating pivotal motion therebetween under a predetermined load.

DESCRIPTION OF THE PREFERRED EMBODIMENT

Figure 3:
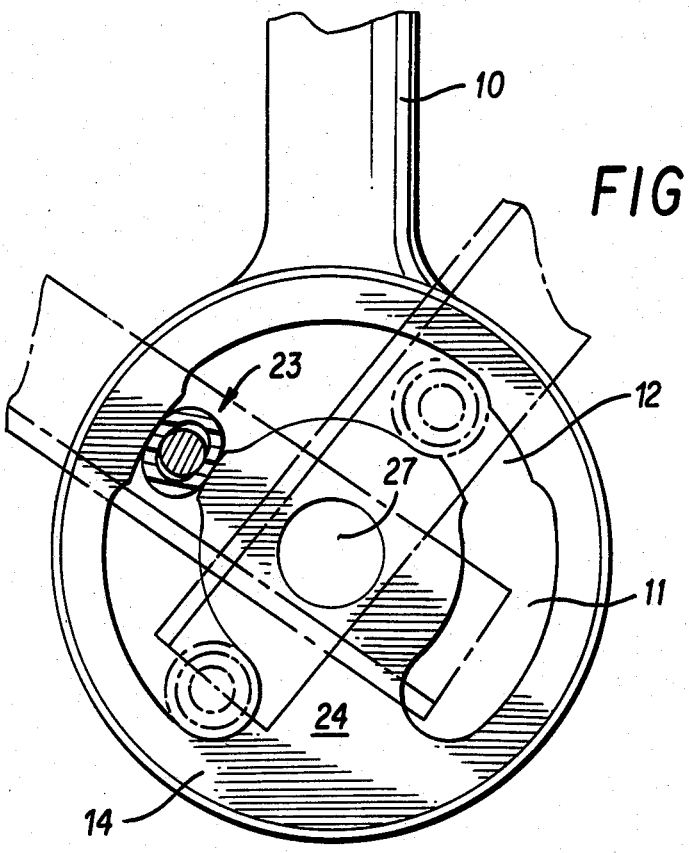
FIG. 3 is a frontal view depicting motion-arresting stops provided for limiting pivotal motion of the anchor flukes realtive to the anchor shank.
Figure 1A:
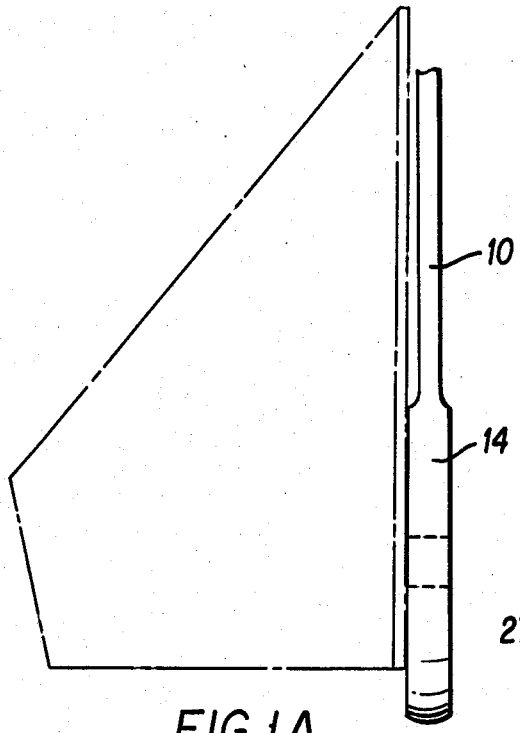
FIG. 1 depicts a side and frontal view of the anchor shaft of the instant invention.
Figure 1B:
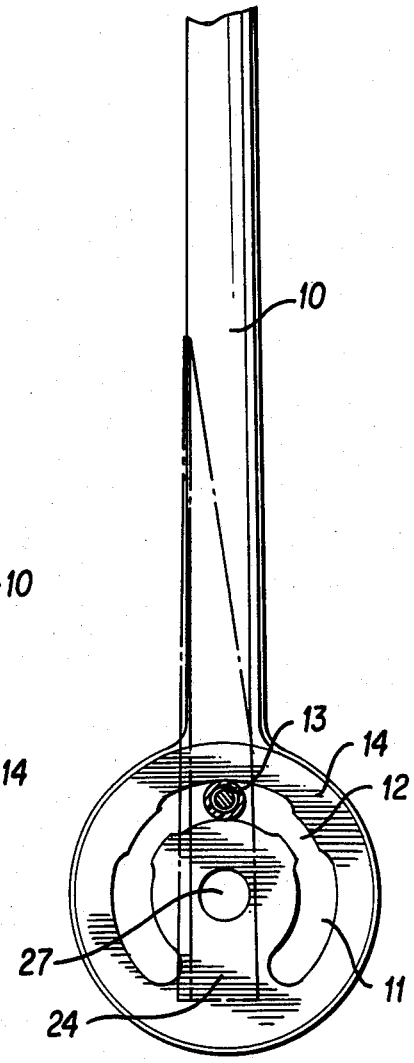

Referring now to the drawings, with more particularity, wherein like reference characters designate like or corresponding parts throughout the several views, there is shown in FIG. 1 an anchor shaft, 10, embodying the principles of the instant invention.

Figure 2A:
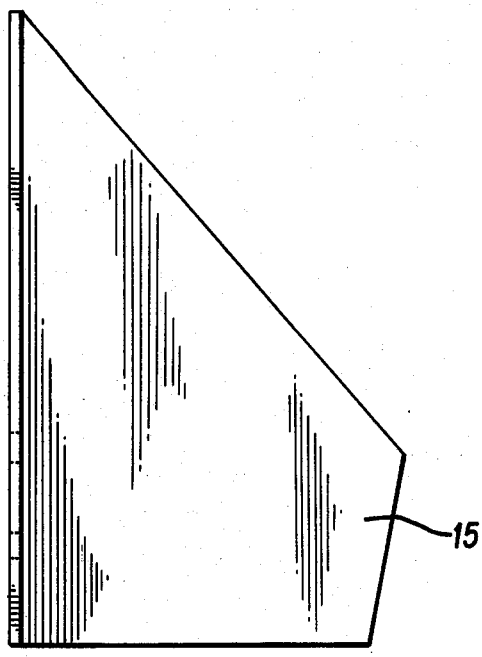
FIG. 2 is an exploded view of the fluke, connecting pins and bushings of the present invention.
Figure 2B:
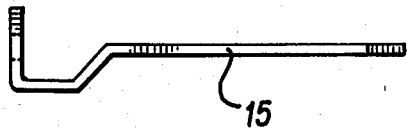
Figure 2C:
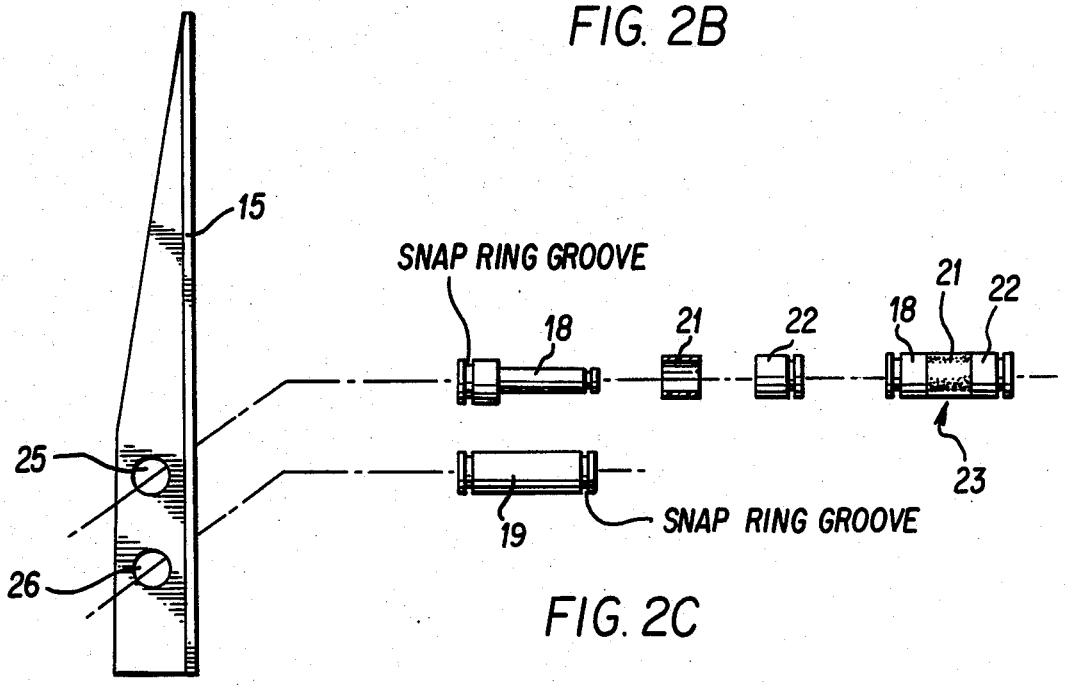

The anchor shaft 10, has attached thereto a pair of wide, flat flukes 15, as shown in FIG. 2, tapered inwardly to a slender point for facilitating a penetration there of into a sand or mud bottom. The flukes 15 are attached to shank 10 through a hub assembly, 14.

Along the innermost edge of each of the flukes 15, there maybe extended a stiffener which serves to enhance the strength of the fluke without significantly increasing the weight thereof.

Hub assembly 14 has arcuate guide slot 11 having a substantially uniform radial dimension except for restriction 12 which has a reduced radial dimension. Arcuate guide slot 11 incompasses from 180° to 330° of the circle inscribed by hub assembly 14. Advantageously arcuate guide slot 11 ascribes from 270° to 310° of hub assembly 14. Preferably acruate guide slot 11 ascribes from 290° to 310° of hub assembly 14. Web 24 comprises the remaining portion of the circle not ascribed by arcuate guide slot 11.

The flukes 15 are provided with transversely oriented, coupling members or pins, designated 13, 18, 19 and 23, respectively, FIGS. 1 and 2. It is noted that in practice the members 18, 19 and 23 comprise a pin or coupling member of such a length to go thru the fluke 15 and hub assembly 14 to attach fluke 15 to hub assembly 14. The coupling members may be of deformable material or may be solid with an exterior comprising a thin wall bushing of deformable material such as neoprene, plastic, steel, brass or the like and are of such a dimension that a predetermined force is necessary to move the coupling members and flukes attached thereto in arcuate guide slide 11 through reduced radial dimension 12. This force is generated when the anchor becomes tangled or stuck and the chain attached thereto is pulled. When sufficient force is applied the coupling members will deform and move through reduced radial dimension 12, thereby "breaking" the fluke-hub assembly attachment and allowing the flukes to rotate and release the anchor.

Fluke 15 is attached to hub assembly 14 through center bore 27 and fluke 15's bore 26. Fluke 15 is attached to hub assembly 14 through arcuate guide slot 11 by means of bore 25. In the normal position the anchor has bore 25 at position 13 in the arcuate guide slot 11 (as shown on FIG. 1).

The ratio of the opening area of slot 11 to the opening area of restriction 12 advantageously is 2 to 1 or less, but must be greater than 1 to 1. Preferably the ratio is less than 2 to 1.25. The most preferred ratio is 2 to 1.5.

Once the anchor is "dropped" and dragged along the bottom, the flukes 15, penetrate the bottom and serve to anchor the vessel. In the event the flukes cannot be extracted in a usual manner, sufficent tension is applied to the anchor line for applying an angular force to the shank 10 sufficient to cause the shank 10-fluke 15 connection to "break" as the coupling pins 18, 19 and 23 deform. Thus the fluke 15 is permitted to rotate to a reversed position into a plane substantially paralleling the plane of the bottom whereby tension now applied by the anchor line is applied to the flukes of the anchor in a direction opposite to that in which forces were applied in causing the flukes to penterate the bottom. Consequently, extraction of the flukes is enhanced.

In view of the foregoing, it is believe to be readily apparent that the anchor of the instant invention comprises an improved anchor assembly which serves to solve many of the problems heretofore encountered by those engaged in the small boat industry.

Although the invention has been herein shown and described in what is conceived to be the most practical and preferred embodiment, it is recognized that departures may be made therefrom within the scope of the invention, which is not be limited to the illustrative details disclosed.

What is claimed is:

1. An improved boat anchor assembly comprising:

A. at least one penetrating fluke;

B. an anchor shank pivotally attached to said fluke;

C. motion limiting means for limiting the pivotal movement of said shank relative to said fluke;

D. releasable coupling means including pins for releasably interlocking said fluke and said shank into an integral configuration, said coupling means further including a hub located on one end of said shank and rigidly affixed thereto;

E. wherein one of said pins extends transversely thru said fluke and thru the center of said hub of the shank;

F. wherein said motion limiting means includes said hub containing motion limiting stops arresting the pivotal motion of the fluke relative to the shank;

G. wherein one of said pins extends transversely thru said fluke and thru the motion limiting portion of said hub;

H. wherein said motor limiting stops of said hub comprise an arcuate guide slot having a substantially uniform radial dimension having at least one restriction of a reduced radial dimension therein;

I. wherein the ratio of the arcuate guide slot opening area to the opening area of said restriction is from 2 to 1 greater that 1 to 1; and J. Wherein said pins are of deformable material such that a predetermined force is necessary to move the pins and the flukes attached thereto in the arcuate guide slot through the at least one restriction.

2. An anchor assembly as defined in claim 1 wherein said arcuate guide slot ascribes from 180° to 330° of the circle described by said hub.

3. An anchor assembly as defined in claim 2 wherein said arcuate guide slot ascribes between 270° and 310° of said hub assembly.

4. An anchor assembly as defined in claim 3 wherein said arcuate guide slot ascribes from 290° to 310° of said hub assembly.

5. An anchor assembly as defined in claim 4 wherein said pin which traverses thru the fluke and the arcuate guide slot of said hub assembly is made of deformable material.

6. An anchor assembly as defined in claim 4 wherein said pin which traverses thru the fluke and the arcuate guide slot of said hub assembly has deformable material on its exterior.

7. The anchor assembly as defined in claim 6 wherein said deformable material is neoprene.

8. An anchor assembly as defined in claim 1 wherein said ratio is less than 2 to 1.25.

9. An anchor assembly as defined in claim 1 wherein said ratio is 2 to 1.5.

10. The anchor assembly as defined in claim 6 wherein said deformable material is plastic.

11. The anchor assembly as defined in cliam 6 wherein said deformable material is steel.

12. The anchor assembly as defined in claim 6 wherein said deformable material is brass.

* * * * *